United States Patent [19]

Hickey

[11] 4,117,875

[45] Oct. 3, 1978

[54] CONTAINERS OR CARRIERS FOR GOODS

[76] Inventor: Christopher Daniel Dowling Hickey, 5 Heathside, Hinchley Wood, Esher, Surrey, England

[21] Appl. No.: 714,656

[22] Filed: Aug. 16, 1976

[30] Foreign Application Priority Data

Aug. 18, 1975 [GB] United Kingdom ..... 34218/75

[51] Int. Cl.[2] ..... F24F 7/02

[52] U.S. Cl. ..... 150/52 R; 251/304; 150/0.5

[58] Field of Search ..... 206/522; 150/52 R, 0.5; 251/304; 137/625.19, 625.47

[56] References Cited

U.S. PATENT DOCUMENTS

| | | | |
|---|---|---|---|
| 3,000,418 | 9/1961 | Bitting | 150/52 R |
| 3,396,904 | 8/1968 | Janette | 251/304 |
| 3,506,237 | 4/1970 | Tometsko | 251/304 |
| 3,783,766 | 1/1974 | Boucher | 150/52 R |
| 3,850,214 | 11/1974 | Hickey | 206/522 |

FOREIGN PATENT DOCUMENTS

| | | | |
|---|---|---|---|
| 2,458,585 | 11/1974 | Fed. Rep. of Germany | 150/52 R |
| 1,191,921 | 5/1970 | United Kingdom | 150/0.5 |

*Primary Examiner*—Ro E. Hart

*Attorney, Agent, or Firm*—Young & Thompson

[57] ABSTRACT

A container or carrier for goods of the kind in which the goods are enclosed in a flexible or partly flexible sealed envelope or skin, the container being partially evacuated so that the flexible skin is forced down by atmospheric pressure to embrace and hold goods on a rigid support has suction means which operate continuously and an adjustable bleed orifice open to the atmosphere to admit air into said container so limiting the vacuum to an adjustable predetermined value.

4 Claims, 4 Drawing Figures

CONTAINERS OR CARRIERS FOR GOODS

BACKGROUND OF THE INVENTION

This invention relates to containers or carriers for goods of the kind in which the goods are enclosed in a flexible or partly flexible sealed envelope or skin, the container being partly evacuated of air so that the skin is caused, under the action of external atmospheric pressure, to embrace and hold the goods together or to hold them onto a rigid support within or forming part of the envelope. Such a container or carrier is described for example in British Pat. No. 1,191,921 and U.S. Pat. Nos. 3,850,214 and 3,000,481.

By using this kind of container, a stable and compact package is obtained which facilitates transportation or handling of the goods. Such containers find particular application in the carriage of goods by aircraft since they enable goods to be held rigidly and firmly without needing the construction of containers specially shaped to fit the goods and without excessive weight.

It is often necesssary to avoid any severe shocks to goods and it is known therefore to provide shock-absorbing mounts for goods in such containers. In such cases, it often becomes important that the vacuum within the envelope should be limited to avoid pulling the cover too hard down so that the shock-absorber mounts are highly compressed. Generally speaking, adequate holding of the goods in position is obtained with only a relatively small vacuum. Typically the reduction in pressure might be of the order of 1½ to 4 lb per sq. inch, i.e., 10,000 to 30,000 $N/m^2$ which is only a small fraction of atmosphere. This is one example of circumstances in which it is desirable to ensure adequate control of the vacuum pressure, even although wide variations can be tolerated. On the other hand, failure of the vacuum would result in absence of any restraint holding down the goods. This has to be avoided in many circumstances.

SUMMARY OF THE INVENTION

According to one aspect of the present invention, a container of the kind described is provided with a vacuum suction means for sucking air out of the container which suction means are adapted to be operated continuously, and there is provided an adjustable bleed orifice open to the atmosphere to admit air into said container or into a pipe leading thereto. Conveniently the adjustable orifice is arranged to admit air into a pipe leading into the vacuum suction duct through which air is drawn from the container.

By this arrangement, the maintenance of vacuum restraint is ensured by providing for continuous vacuum suction. In the well-known way, this may be achieved by using a vacuum suction pump together with a suitable vacuum reservoir. The bleed orifice however limits the extent of the vacuum. It will be readily appreciated that the amount of air admitted through the bleed hole will depend on the pressure difference that is to say the extent to which the pressure in the container falls below atmospheric. Since the vacuum is only a small fraction of an atmosphere, this pressure difference is quite small. It can readily be permitted to vary over quite wide limits and the system is self-regulating in maintaining the vacuum within the required tolerance.

Preferably the container is provided with a pressure gauge to indicate the pressure and the adjustable bleed can be set to ensure that this pressure is within the required range. The actual setting for any given container will depend on the tightness of the seals, etc. and may vary from container to container.

The invention also includes within its scope a container comprising a rigid impermeable base, resilient support means on said base for carrying goods, a flexible impermeable envelope, means for releasably sealing said envelope to said base, a vacuum duct through said base for extracting air from within the envelope, an air extraction pump connected to said duct and a bleed duct with an adjustable orifice for admitting air into the region between the envelope and the base.

The invention furthermore includes within its scope a method of packaging goods in a container of the kind described wherein the flexible skin forming part of the container is drawn down onto the goods by maintaining a partial vacuum within the container and wherein the partial vacuum is maintained by continuous suction from the container, an adjustable bleed being provided for admitting air into the container or a duct leading thereto to regulate the extent of vacuum in the container.

DESCRIPTION OF THE PREFERRED EMBODIMENT

Figure 1:
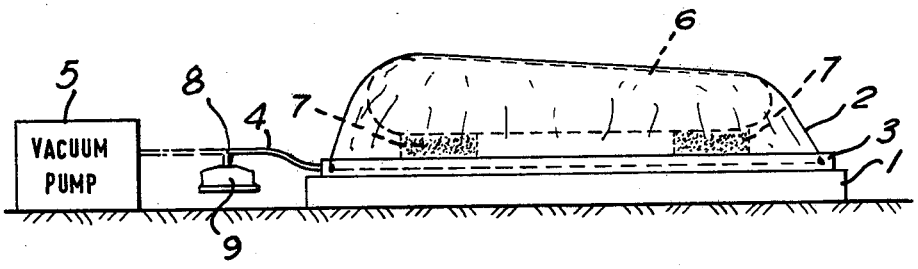
FIG. 1 illustrates a container assembly with an adjustable bleed, the container being subjected to continuous air evacuation.

Referring to FIG. 1, there is shown a container comprising an impermeable metal base 1, typically formed as a pallat, and a flexible envelope or cover 2 of impermeable material, e.g. butyl rubber. The cover has, extending around its periphery, an inflatable tube, which can be inserted in a channel 3 or groove in the base 1 to seal the cover to the base. Reference may be made to United States Patent No. 3,850,214 for a fuller description of such a seal. The inflatable tube may be integral with or attached to the envelope or may be separated therefrom, e.g. secured in the channel 3.

Figure 2:
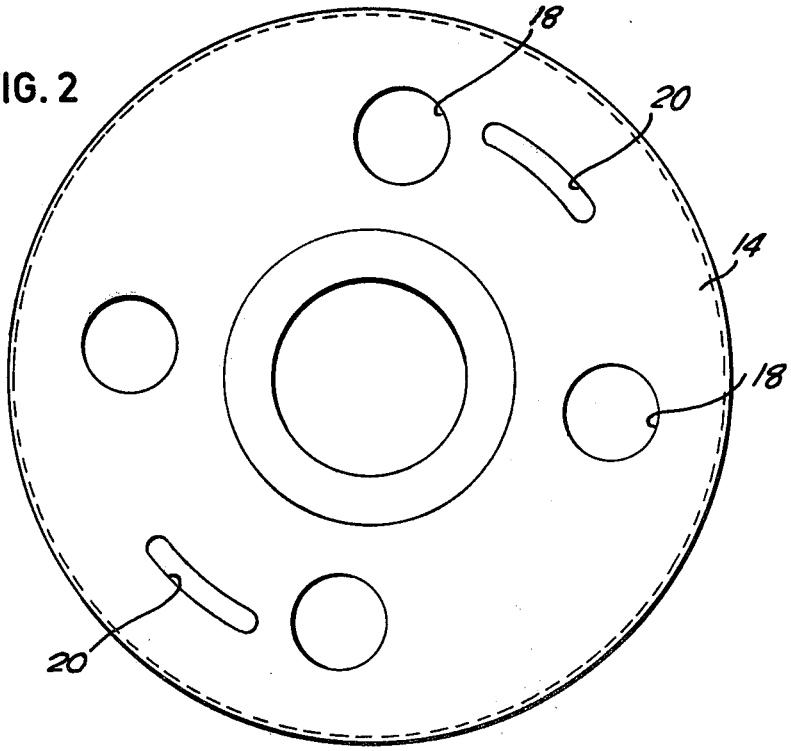
FIGS. 2 and 3 are plan views of a cover part and casing part of an adjustable bleed, used in the container assembly of FIG. 1.
Figure 3:
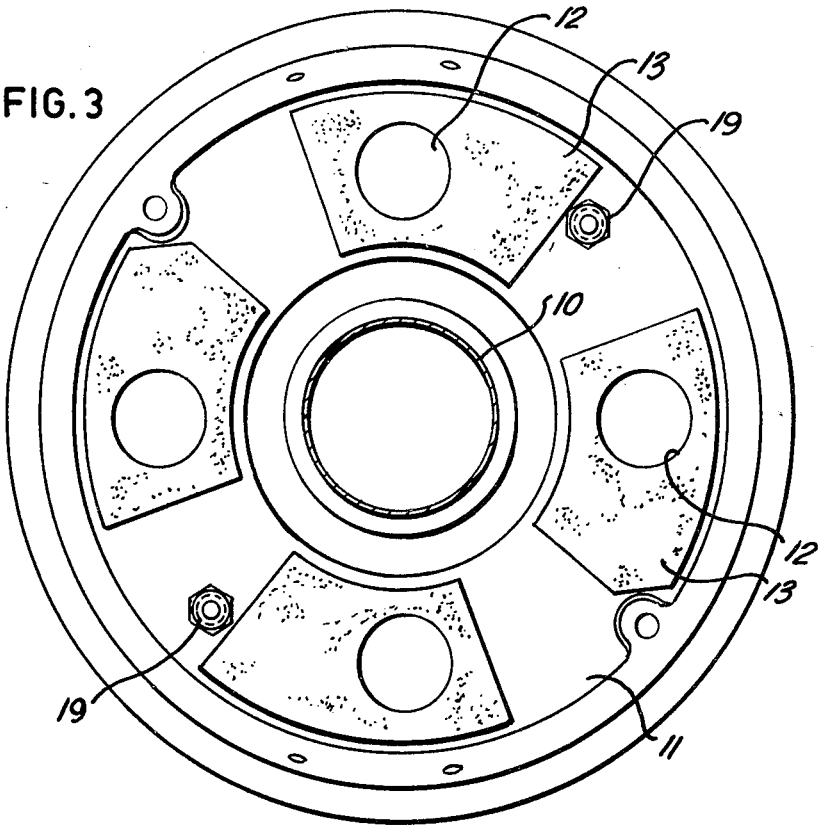
Figure 4:
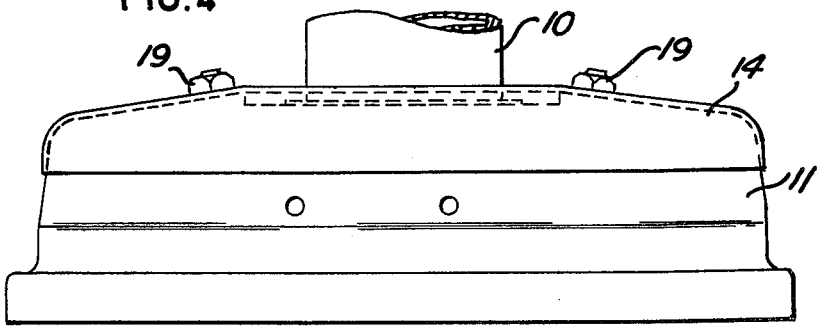
FIG. 4 is a diametral section through the cover part and casing part of the bleed when assembled together.

An air duct 4 leading to a vacuum pump 5 is provided for evacuating air from within the envelope 2 so that this envelope is sucked down onto goods, shown diagrammatically at 6, which are supported on shock-absorbing mounts 7 on the base 1. The duct 4 has a T-junction 8, the branch portion of which leads to an adjustable bleed 9 via a pipe 10. The adjustable bleed 9 comprises a main casing shown in FIGS. 3 and 4. The pipe 10 leads into the centre of a generally cylindrical casing member 11 having four circular ports 12 evenly spaced around its axis on an upper end surface. Each port is surrounded by a rubber pad 13 so that a cover member 14 (FIG. 2) which is rotatably mounted on the pipe 10 is closely adjacent these rubber pads. The cover member 14 is shaped to fit closely over the casing member 11 and has four equally-spaced apertures 18 located in a similar manner to the ports 12 on the casing member 11. Thus, if the cover 14 and casing 11 are arranged with the apertures 18 aligned with ports 12, air can pass freely into the casing from the outer atmosphere whereas, by rotation of the cover relative to the casing through a few degrees, entry of air is inhibited, the aforementioned rubber pads providing effective seals over the holes in the cover. Intermediate positions give a restricted air entry.

Bolts 19 with hank bushes are mounted on the casing with the bolt heads above the cover, the bushings passing through slots 20 in the cover. These bolts 19 and slots 20 limit the angular rotation of the cover and enable the cover to be locked in any required position by tightening the bolts.

In use, the vacuum pump is operated continuously so as to extract air from within the envelope 2. The adjustable bleed 9 regulates the extent of vacuum maintained within the container and ensures that there is no possibility of any excessive vacuum being developed which pulls the envelope 2 so hard down that the shock absorber mounts are highly compressed.

I claim:

1. A container of the kind having an impermeable envelope or skin which is at least partly flexible and a vacuum suction means for sucking air out of the container wherein the suction means are adapted to be operated continuously, and wherein there is provided an adjustable bleed orifice open to the atmosphere to admit air into a pipe leading into the vacuum suction duct through which air is drawn from the container.

2. A container as claimed in claim 1 and provided with a pressure gauge to indicate the pressure within the container.

3. A container comprising a rigid impermeable base, resilient support means on said base for carrying goods, a flexible impermeable envelope, means for releasably sealing said envelope to said base, a vacuum duct through said base for extracting air from within the envelope, an air extraction pump connected to said duct and a bleed duct with an adjustable orifice open to the atmosphere for admitting air into said vacuum duct.

4. A container as claimed in claim 3 wherein said adjustable orifice comprises a pair of parallel plates, having corresponding apertures therethrough, sealing means between the plates around the apertures on one plate, said plates being mounted for relative movement to bring the apertures into and out of alignment.

* * * * *